US005284131A

United States Patent [19]

Gray

[11] Patent Number: 5,284,131

[45] Date of Patent: Feb. 8, 1994

[54] THERAPEUTIC EXERCISE DEVICE FOR LEGS

[76] Inventor: Errol Gray, Apt. #4, 72 Pretoria Avenue, Ottawa, Ontario, Canada, K1S 1W9

[21] Appl. No.: 846,879

[22] Filed: Mar. 6, 1992

Related U.S. Application Data

[63] Continuation-in-part of Ser. No. 623,020, Dec. 6, 1990, abandoned.

[30] Foreign Application Priority Data

Nov. 26, 1990 [CA] Canada ..... 2030864

[51] Int. Cl.[5] ..... A61H 1/02

[52] U.S. Cl. ..... 128/25 B; 128/25 R; 482/57; 482/904

[58] Field of Search ..... 128/25 R, 25 B; 482/57, 482/79, 80, 124, 904

[56] References Cited

U.S. PATENT DOCUMENTS

| | | |
|---|---|---|
| Re. 32,547 | 11/1987 | Reed et al. . |
| 4,402,502 | 9/1983 | Peters . |
| 4,478,213 | 10/1984 | Redding . |
| 4,733,880 | 3/1988 | Wilhelm, III . |
| 4,824,132 | 4/1989 | Moore . |
| 4,867,441 | 9/1989 | Blakeman . |
| 4,915,374 | 4/1990 | Watkins . |
| 4,928,673 | 5/1990 | Heneger . |
| 4,973,046 | 11/1990 | Maxwell . |
| 5,033,736 | 7/1991 | Hirschfeld . |

FOREIGN PATENT DOCUMENTS 4394 12/1912 United Kingdom .

*Primary Examiner*—Richard J. Apley
*Assistant Examiner*—Linda C. M. Dvorak
*Attorney, Agent, or Firm*—Burke-Robertson

[57] ABSTRACT

A device for promoting health and rehabilitation through exercise by way of providing motion to one's legs. The device comprises a frame, with a motor secured to the frame. An axle extends outwardly from the frame to either side and is powered by the motor for rotation about a horizontal axis. The axle drives a pair of crank arms to the free ends of which are secured pedals. The pedals are adjustable so that their axes of rotation are adjustable with respect to the axis of rotation of the axle. Straps or the like associated with each of the pedals to releasably secure a user's foot to the pedal. A flexible leg support strap extends from a portion of the frame. In operation, an end of the strap is wrapped around a leg just behind the knee. The strap is of a length and is positioned so that the leg is free to move as the pedal rotates with one's foot strapped to the pedal while sufficient force is provided by the strap on the leg to prevent unwanted lateral movement of the leg. The device of the present invention in use provides a wobble-like motion to the legs, during operation, to further enhance joint and muscle mobility in the user's legs.

12 Claims, 2 Drawing Sheets

THERAPEUTIC EXERCISE DEVICE FOR LEGS

This is a continuation-in-part of application Ser. No. 07/623,020 filed Dec. 6, 1990, now abandoned.

BACKGROUND OF THE INVENTION

This invention relates to a device for promoting health and rehabilitation through exercise by way of providing motion to one's legs. More particularly, the present invention relates to such a device which gives a rotary motion to the legs of a user, while those legs are in a passive state, while that person is in a wheelchair or seated position away from the device.

Rotary, health promoting, powered exercise machines have long been known for providing helpful exercise and therapeutic treatment for children and adults who have different degrees of disabilities. Individuals who have suffered partial paralysis, e.g. spinal injury, strokes, arthritis, chronic back pain, multiple sclerosis, muscular dystrophy and the like have the need to exercise or range their unused or underused muscles or limbs. Failure to do so can result in stiffened joints and tendons, and atrophy of the muscles leading to a generalized limb pain as well as a general deterioration of the cardiovascular system including increased susceptibility to blood clots. On the other hand, the therapeutical value of even strictly passive limb exercise is quite indisputable for helping to counteract the effects of long term immobilization. Such exercise tends to make joints more flexible, helps prevent atrophy of muscles and tendons, increases circulation thus removing the causes of pain in a limb, enables the heart to work more efficiently, and gives rise to a general feeling of well being.

Patents of general background interest relating to leg exercise devices for persons in wheelchairs include Canadian Patent No. 891,657 of McGuire issued Jan. 25, 1972, Canadian Patent No. 1,177,503 of Peters issued Nov. 6, 1984, Canadian Patent No. 1,202,221 of Schotten issued Mar. 25, 1986, Canadian Patent No. 1,255,709 of Kopnicky issued Jun. 13, 1989, U.S. Pat. No. 4,615,335 of Searcy issued Oct. 7, 1986, U.S. Pat. No. 4,717,146 of Nohara issued Jan. 5, 1988, U.S. Pat. No. 4,773,399 of Richardson issued Sept. 27, 1988 and U.S. Pat. No. 4,869,494 of Lambert issued Sept. 26, 1989.

Other patents of general background interest relating to exercisers for disabled persons, on which the disabled persons are seated, include Canadian Patent No. 1,140,181 of Reynolds issued Jan. 25, 1983 and U.S. Pat. No. 4,863,157 of Mendel, et al issued Sept. 5, 1989.

Such known devices have been subject to a number of disadvantages. While all have some sort of a rotating pedal mechanism on which the user's leg is positioned during operation, most have provided a fixed amplitude for the crank arm which orbits the leg on the pedals. This means that unless the amplitude chosen is very small, the device cannot be used by children or adults with a small range of non-painful movement such as would occur after an accident or operation or after a long period of inactivity. In such cases, it is desirable to start off with a small range of movement and work up to larger amplitudes of orbital motion as flexibility in the joints, muscles and tendons is restored.

Another limitation of such known devices concerns the restraint system used to guide paralysed limbs during their orbital motion. In this regard, it should be understood that the upper end of the leg is anchored firmly into the hip joint which leaves the knee and ankle free to pivot about an axis perpendicular to the plane of orbital motion of the pedals. However, in a paralysed limb, as the knee bends, there is a tendency for the knee to flop either inwards or towards the other knee, or outwards to the point where severe damage to joints and tendons can occur. Various techniques have been used to overcome this problem. In general, the foot is secured to a foot holder on the pedal having restraining straps and two or more raised edges, the foot holder in turn being attached to a pedal. Peters Canadian Patent No. 1,177,503 teaches an L-shaped attachment to the pedal which secures the lower leg at right angles to the foot. While very effective in preventing unwanted lateral movement of the knee, the disadvantage of this method is that the beneficial effects of movement on the ankle and achilles tendon are prevented. For a stroke victim, exercise of the ankle and achilles tendon is necessary to retain the ability to put the heel on the ground when standing.

Another method of restraint that has been previously used has been to insert some part of the apparatus between the legs so that inward movement of the legs is prevented by contact with smooth panels (see e.g. Peters Canadian Patent No. 1,177,503 or Schotten Canadian Patent No. 1,202,221). This however gives rise to rubbing on the inside of the knee and does not prevent the knees from flopping outwardly during operation of the devices in question, although it does enable the ankles to move normally.

A further disadvantage of such known devices for movement of passive legs is that they invariably confine themselves to a mode of operation where the axis of rotation of the foot pedal is always parallel to the axis of rotation of the crank. This restricts the range of motion available for a limb such as a leg, which has a reasonable degree of flexibility.

Maxwell U.S. Pat. No. 4,973,046 issued Nov. 27, 1990 describes and illustrates an adjustable therapeutic exerciser for lower human extremities comprising a pair of motor driven pedal cranks carrying pedals on the outer arms. The pedals extend laterally outwardly parallel to the axis of rotation of the cranks, and have pedal plates which are universally adjustable by way of a ball and socket arrangement, over each of the pedals. In this manner the foot supporting plates may be adjusted for comfort of the user and to provide a different, albeit constant, angular adjustment of each foot plate throughout each rotation of the crank arm, depending on the selected angular positioning the plate.

Redding U.S. Pat. No. 4,478,213 issued Oct. 23, 1984 describes and illustrates a therapeutic manipulator wherein, motor driven pedals are provided. The device further has a pair of knee support straps supported for lateral movement in a hollow support arm. For the knee support straps to operate properly, both legs must be supported, so that one end of the strap is counterbalanced by the other during operation of the device.

It is an object of the present invention to provide a device for exercise of passive legs by a patient seated in a wheelchair or the like, which overcomes the above-noted problems.

It is a further object of the present invention to provide a passive leg exerciser which will provide a wobble-like motion to the legs, during operation, to further enhance joint and muscle mobility in the user's legs.

SUMMARY OF THE INVENTION

In accordance with the present invention a device is provided. The device comprises a frame, with a motor secured to the frame. An axle extends outwardly from the frame to either side and is powered by the motor for rotation about a horizontal axis. A pair of crank arms are secured to the axle on either side, to rotate in a plane perpendicular to the axis of rotation of the axle. Adjustment means are secured to the free end of each of the crank arms. The device further comprises a pair of pedals, each one secured to a different one of the adjustment means to rotate about its own pedal axis. Means are associated with each of the pedals to releasably secure a user's foot to a portion of the pedal. An elastic leg support strap extends from a portion of the frame. In operation, an end of the strap is wrapped around a leg just behind the knee. The strap is of a length and is positioned so that a leg is free to move as the pedal rotates with one's foot strapped to the pedal while sufficient force is provided by the strap on the leg to prevent unwanted lateral movement of the leg. The adjustment means operates so as to permit adjustment of the angle of the axis of rotation of the pedal with respect to the axis of rotation of the axle to permit varying the orientation of the foot and leg of a user as they move on the foot pedal during operation of the device.

The present invention provides a restraint system on an exercise device which prevents orbiting passive legs from moving too far out of the plane of motion. As well, modes of operation can be provided wherein the axis of rotation of the foot pedal is other than parallel with the axis of rotation of the axle, providing greater variation of controlled movement of the user's legs and thereby increasing therapeutic benefit.

BRIEF DESCRIPTION OF THE DRAWINGS

These and other objects and advantages of the invention will become apparent upon reading the following detailed description and upon referring to the drawings in which.

Figure 1:
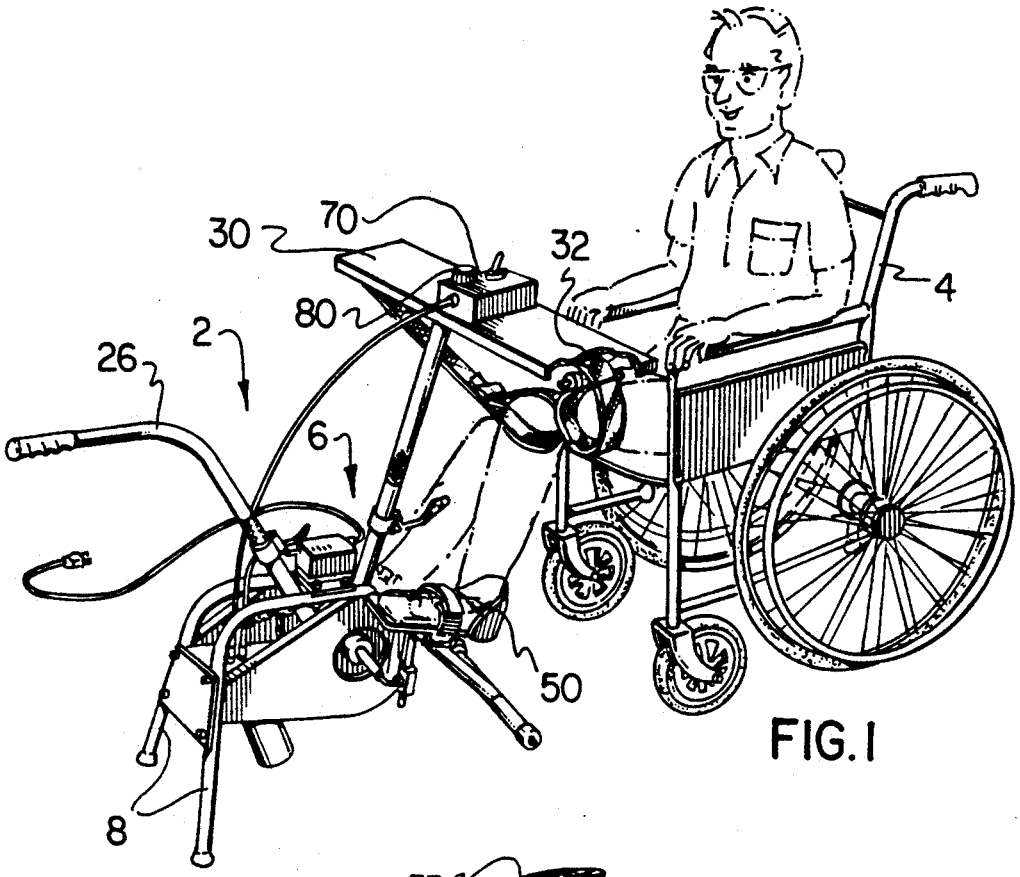
FIG. 1 is a perspective view of a device according to the present invention in use by a patient in a wheelchair.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Figure 2:
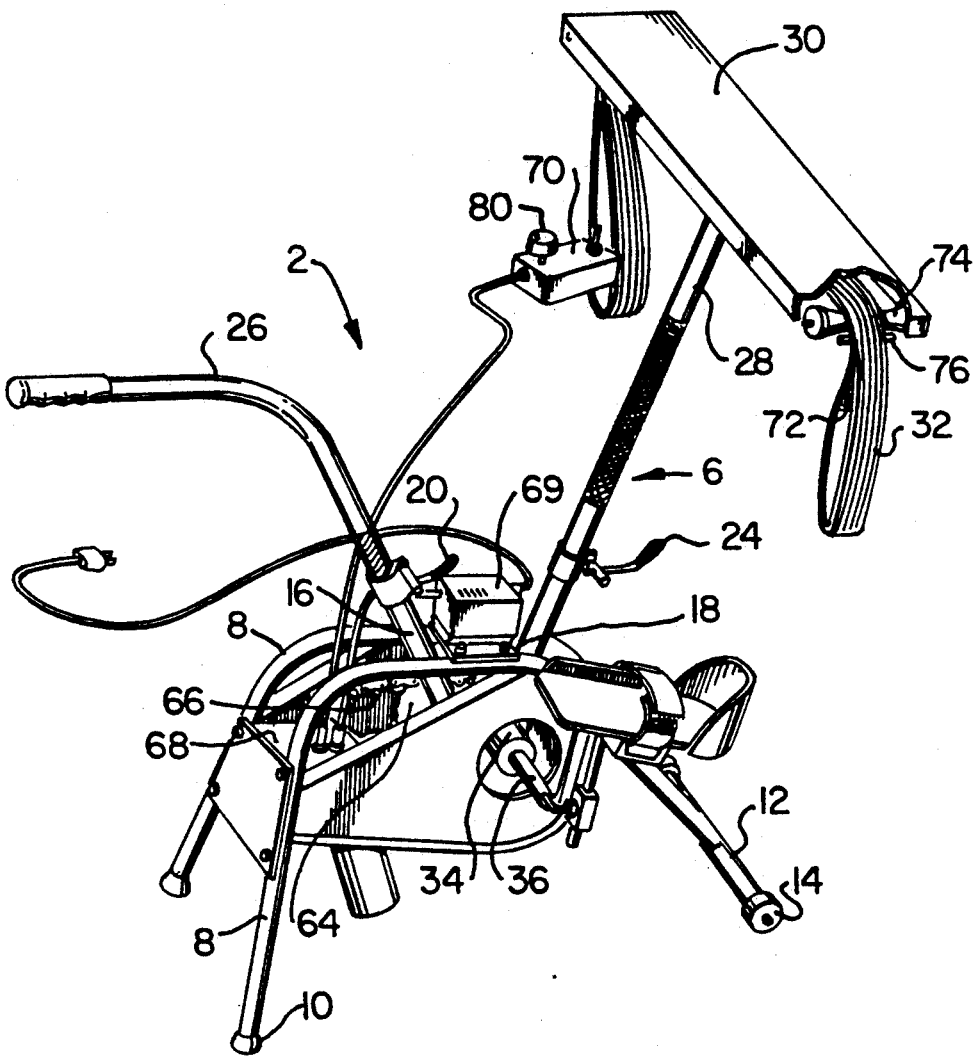
FIG. 2 is a more detailed perspective view of the device of FIG. 1.

Turning to FIGS. 1 and 2, there is illustrated a device 2 for exercising passive legs of a remotely seated person for example in a wheelchair 4, in accordance with the present invention. Device 2 comprises a frame 6 having a base formed from two tubular elements 8 extending upwardly from floor grip caps 10 which provide frictional contact with the floor. These two tubular elements 8 are bent over in the form of a "U" as illustrated, and end in a third tubular element 12 which is in permanent contact with the floor by way of two rubber wheels 14. Arising from between tubular elements 8 are two other tubular elements 16 and 18 which terminate in adjustment means 20 and 24 respectively (FIG. 2) for adjustably controlling the heights of two further tubular elements 26 and 28 which telescopically extend from, respectively, tube 16 and 18 as illustrated. Tube 26 is used as a handle to lift the rear of the device off the floor so that it can be moved around by means of wheels 14. The other tube 28, which is oriented at a few degrees off vertical, extends forwardly of the device, and provides a support for frame portion 30 within which is slidably mounted, as will be described in more detail hereinafter, a flexible leg support strap means 32.

Figure 3:
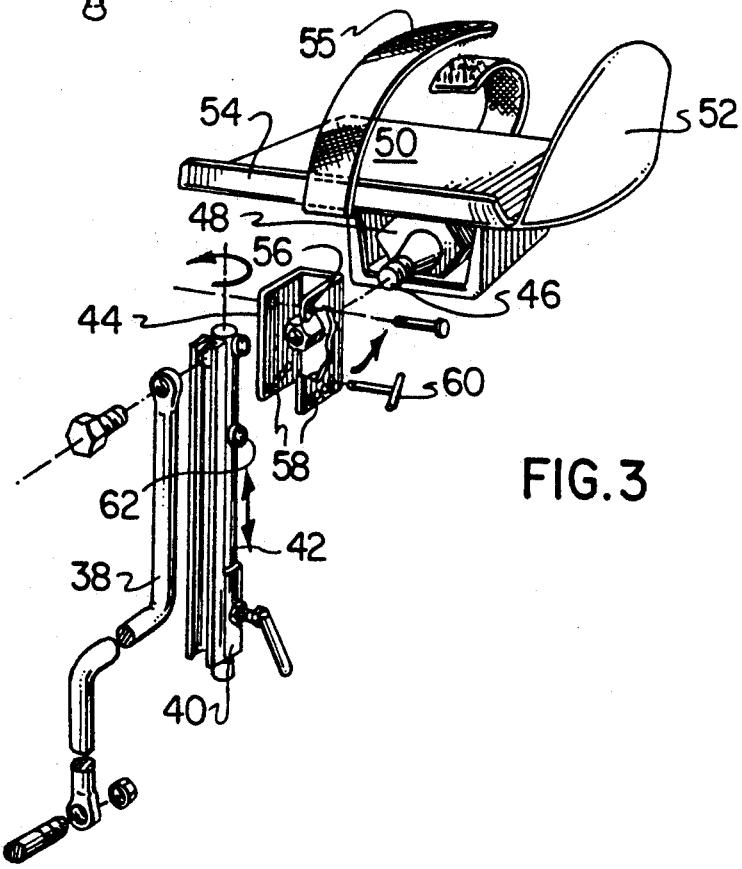
FIG. 3, on the first page of drawings, is a perspective, exploded view of a foot pedal arrangement of the device of FIG. 1.

At the junction of tubes 16 and 18 is a bearing 34 containing a rotatable axle 36 which extends outwardly on either side of device 2 and rotates relative to the frame about a horizontal axis. On each side of axle 36 is attached a crank arm 38 (FIGS. 2 and 3) to which is secured an adjustment means 40 to which is slidably attached a crank arm extension 42 to permit the effective length of crank arm 38 to be extended or reduced. Crank arm 38 rotates in a vertical plane. At the free end of crank arm 38 is secured a threaded clevis 44 which engages the threaded shaft 46 which protrudes from pedal 48. A foot plate 50 having a heel supporting end upwardly extending from plate 50 and an upwardly extending side edge 54 is secured to pedal 48. Appropriate straps 55 are used to secure each foot into its appropriate foot plate 50. Pedal 48 rotates about the axis of shaft 46 in conventional fashion, and normally the axis of rotation of pedal 48 would be parallel to the axis of rotation of axle 36. Threaded clevis 44 however is adjustably attached to the end of crank arm extension 42 so that for example when crank arm 38 and extension 42 are vertically positioned the pedal axis is adjustable to one or more vertical angles with respect to the axis of rotation of axle 36. This adjustment of clevis 40 is achieved by securing one end of clevis 40, through apertures 56, to the corresponding end of crank arm extension 42, so that clevis 44 is rotatable, a limited degree about the axis passing through apertures 56, this axis being perpendicular (when the extension arm is vertical) in the horizontal plane to the axis of rotation of axle 36. At the other end of clevis 44 are spaced aligned holes 58 through which a pin 60 may pass, when a pair of aligned apertures on upper and lower arms of clevis 44 are themselves aligned with a single aperture 62 in crank arm extension 42. Adjustment of the angle between the axis of the pedal and axle 36 is thereby achieved so that the pedal axis of rotation, during operation of the device may follow a cylindrical path or a conical one. In this manner the angle may be adjusted in specific, predetermined increments making duplication of a preferred angle of adjustment of the pedal axis, or variation therefrom to a limited degree, easily reproducible by a user or technician.

In addition to the above-mentioned rotation of the pedal axis or as an alternative thereof, means may be provided for relative rotation of crank arm extension 42 about its longitudinal axis, for further adjustment of the orientation of the axis of rotation of foot pedal 48 during operation of the device, such that the pedal will follow yet other conical paths as the crank arm 38 and extension 42 rotate in their vertical plane. In this instance, assuming the crank arm is again vertically oriented, relative rotation of crank arm extension 42 permits adjusting of the foot pedal axis of rotation at a horizontal angle with respect to the axis of rotation of the axle.

Axle 36 joining opposite crank arms 38, on either side of device 2, is attached to a sprocket 64 which is driven by a chain 66 from another sprocket (not illustrated) attached to an electric motor 68, in conventional fashion. Power for the motor is derived from the power pack 69. Motor 68 is preferably provided with an on/off control, a speed control and a forward and reverse switch. These may be located on a remote control unit 70 which can be patient operated.

Leg support, during operation of the unit, if and as required, is provided by flexible leg support strap means 32. This is formed for instance by a wide elastic band. One end of the band is looped around a user's leg just behind the knee and secured to a portion of the band, by means for example of hook and pile fasteners 72. The other end of the band is supported within frame portion 30 which has been positioned above the knee. Since a paralysed leg is most likely to move laterally when the foot and knee are at the top of their travel, the elastic supporting material must be capable of supplying sufficient upwards force to prevent undesired lateral movement and yet be capable of stretching for example a further ten inches or so to allow the knee to go to the bottom of its travel without overstretching the material or allowing the build-up of an excess of force which could stall the machine or cutoff circulation, or cause pain on the limb. One way to reduce the disparity between forces at the top and bottom of the motion is to increase the unstretched length of the elastic material. This could be done by positioning a support means above each knee at whatever height is desired and attaching individual bands. However, the greater the distance between the point of support and the knee, the less the lateral restoring force for a given tension on the elastic band. Thus, a more practical and preferred construction is, as illustrated, to couple the two legs together since as one leg goes up, the other leg goes down. In this way the disparity between the tension at the top and bottom of the motion is virtually eliminated. In this preferred embodiment, the two legs are coupled together by means of a single elastic band looped over two parallel horizontal pulleys 74, rotatably secured within frame portion 30 as illustrated, and hence at an adjustable height above the knees. Each end of band 32 is looped under a corresponding knee, folded back on itself and secured by means of hook and pile fasteners 72 to another portion of the band. By choosing a pathway of approximately twenty inches between pulleys 74, within frame portion 30, adequate travel and pre-tension can be achieved. By adjusting the pre-tension in band 32 and the height of the pulleys 74 above the knees, any desired amount of lateral restoring force can be achieved when the knee is at the top of its travel.

An initial pre-tension in the elastic band may be created by attaching dowels 76 to band 32 on either side of the centre, spaced a few inches less than the length of the path between pulleys 74. By so attaching the dowels to band 32, after the elastic band has been threaded over the pulleys 74, the elastic band is held in place under tension and cannot be removed because the dowels 76 are wedged between the rollers 74 and corresponding portions of frame portion 30.

The shape of pulleys 74 is important. As a user's knees go up and down, the changing forces on the elastic material forming strap means 32 tend to move the strap means from one side of the roller to the other. This places undue strain and wear on the edges of the elastic material. It has been found that by widening the roller to approximately twice the elastic band width, and hollowing out the centre of the pulleys 74, the jamming of the elastic material against the edges of frame portion 30 is avoided. Alternatively instead of pulleys 74, U-bolts (not illustrated) may be used with the band, feeding over the U-bolts between their arms, the U-bolt either vertically or horizontally mounted.

In operation, device 2 is wheeled up to a patient seated in a wheelchair 4 or a lounge chair. The foot support straps 55 are used to secure each foot into its appropriate foot plate 50 and the flexible leg support strap means 32 if required are placed in position around the legs. The unit is turned on and the speed control 80, on remote 70 is rotated until motion begins. Once the desired speed is attained, the length of time of operation is determined by the patient. Because of the elasticity of straps 55, if it is desired to support only a single leg of a patient, this may be readily accomplished by simply connecting one end of flexible leg support strap means 32 to the patient's leg to be exercised. It is not necessary to have the user's other leg counterbalance the other end of strap means 32, since dowel 76, at the other side of that strap means, will automatically and appropriately limit the amount of lateral movement of the strap and maintain appropriate restoring force in that portion of the strap means 32 associated with the user's leg being exercised.

In regard to the relative rotation of foot plate 50 and clevis 44, with respect to crank arm 38, before the foot is strapped into position, adjustment of the angle between the pedal axis and that of the axle is achieved by means of matching an appropriate pair of aligned oppositely positioned apertures 58 on clevis 44 with aperture 62 on crank arm extension 42 and securing that position of clevis 44 by pin 60. It is preferred that an angle between 0° offset (normal pedal position with axis of pedal aligned with axis of axle) and 20° offset be provided by clevis 44 to give a desired range of movement. Of course, adjustment of crank arm extension 42 can provide orbital motion of the legs with an appropriate amplitude.

Also crank arm extension 42 can be rotated about its longitudinal axis and held in place to provide other conical paths for the pedal axis to follow.

Thus it is apparent that there has been provided in accordance with the invention a device for exercising passive legs of a person that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A device for exercising passive legs of a person seated remotely with respect to the device, the device comprising:

(a) a frame;

(b) a motor secured to the frame;

(c) an axle extending outwardly from the frame to either side, the axle powered by the motor for rotation about a horizontal axis;

(d) a pair of crank arms secured to the axle on either side, the crank arms to rotate in a plane perpendicular to the axis of rotation of the axle;

(e) adjustment means secured to the free end of each of the crank arms;

(f) a pair of pedals, each secured to a different one of the adjustment means to rotate about its own pedal axis;

(g) means associated with each of the pedals to releasably secure a user's foot to a portion of the pedal; and (h) elastic leg support strap means extending from a portion of the frame, in operation an end of the strap means to be wrapped around a leg just behind the knee and the strap means being of a length and positioned so that a leg is free to move as the pedal means rotates with one's foot strapped to the pedal means while sufficient force is provided by the strap on the leg to prevent unwanted lateral movement of the leg, said adjustment means operable so as to permit selection of a predetermined angle which the pedal axis of rotation makes with respect to the axis of rotation of the angle so that the pedal axis will automatically follow a conical path thereby to permit varying the orientation of the foot and leg of a user as they move on the foot pedal during operation of the device.

2. A device according to claim 1 wherein the elastic leg support strap means is laterally slidable within a portion of the frame, opposite ends of the flexible leg support means extending from the frame at spaced locations, each end of the strap means to be wrapped around a corresponding leg of the user just behind the knee, the strap means being of a length and positioned so that each leg is free to move as the pedal rotates with one's foot strapped to the pedal means while sufficient force is provided by the strap on that leg to prevent unwanted lateral movement.

3. A device according to claim 2 wherein a pair of stop means is provided on portions of the strap means exterior to the frame to limit the lateral sliding movement of the strap means, in either direction, with respect to the frame.

4. A device according to claim 3 wherein rollers are provided within the frame on which the strap means is positioned for lateral sliding movement, and wherein the pair of stop means comprises dowels secured to the strap means at appropriate locations so as to abut against the frame to prevent further lateral movement of the strap means in a given direction after the strap means has moved laterally in that direction a predetermined amount.

5. A device according to claim 3 wherein the pair of stop means comprises dowels secured to the elastic leg support strap means after the strap means has been extended so that the dowels bear against the frame at spaced locations, thereby placing the strap means under a predetermined amount of the tension within the frame, whereby the amount of restoring forces achieved by the strap means during operation, when a user's knee is at the top of its travel, is predetermined.

6. A device according to claim 1 wherein the end of each crank arm opposite to that which is secured to the axle is secured to a clevis to which the foot pedal is secured to rotate about its axis relative thereto, the clevis secured to said end of the crank arm so as to be adjustably positionable therewith to adjustably orient the axis of rotation of the foot pedal, when the crank arm is vertically oriented, at varying angles vertically with respect to the axis of rotation of the axle.

7. A device according to claim wherein the crank arm further comprises an adjustment means to effectively lengthen or shorten the length of the crank arm.

8. A device according to claim 6 wherein means are associated with each crank arm and foot pedal to adjustably orient the foot pedal axis of rotation when the crank arm is vertically oriented, at varying angles horizontally with respect to the axis of rotation of the axle.

9. A device according to claim 1 wherein the foot pedal further comprises a foot plate to supportably receive a user's foot.

10. A device according to claim 9 wherein strap means are associated with the foot plate to releasably secure a user's foot on the foot plate during operation of the device.

11. A device according to claim 1 further provided with means to adjust the vertical height of the portion of the frame from which the flexible leg support strap means extends, with respect to other portions of the frame.

12. A device according to claim 6 wherein the clevis is constructed so as to provide a plurality of specific predetermined increments of adjustment for the angle of the axis of rotation of the corresponding foot pedal with respect to the axis of rotation of the axle.

* * * * *